US007580650B2

(12) United States Patent
Kitamura

(10) Patent No.: US 7,580,650 B2
(45) Date of Patent: Aug. 25, 2009

(54) IMAGE FORMING DEVICE AND IMAGE FORMING METHOD INCLUDING FORMATION OF A TONER PATCH

(75) Inventor: Kazuya Kitamura, Nagoya (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 96 days.

(21) Appl. No.: 11/647,320

(22) Filed: Dec. 29, 2006

(65) Prior Publication Data

US 2007/0286620 A1 Dec. 13, 2007

(30) Foreign Application Priority Data

Jun. 8, 2006 (JP) ..... 2006-160058

(51) Int. Cl.
*G03G 15/01* (2006.01)
*G03G 15/16* (2006.01)

(52) U.S. Cl. ..... 399/72; 399/49; 399/66

(58) Field of Classification Search ..... 399/49, 399/72, 66, 302, 308, 162, 301; 347/19, 347/116, 117
See application file for complete search history.

(56) References Cited

U.S. PATENT DOCUMENTS 5,499,092 A 3/1996 Sasaki
5,600,421 A * 2/1997 Takekoshi et al. ..... 399/66
5,678,149 A * 10/1997 Takekoshi et al. ..... 399/299
5,867,759 A 2/1999 Isobe et al.
6,198,896 B1 * 3/2001 Nakayasu et al. ..... 399/301
2002/0061378 A1 * 5/2002 Kusaba et al. ..... 428/36.92
2005/0095025 A1 * 5/2005 Kyung ..... 399/66

FOREIGN PATENT DOCUMENTS

JP 63-279274 11/1988
JP 7-295392 11/1995
JP 8-220902 8/1996
JP 10-73981 3/1998
JP 11-184278 7/1999
JP 2002-6645 1/2002

OTHER PUBLICATIONS

Machine translation of JP 08-220902 A dated Aug. 22, 2008.*
Japanese Notification of Reasons for Refusal, mailed Apr. 30, 2008, directed to corresponding Japanese Patent Application No. 2006-160058. 13 pages.

* cited by examiner

*Primary Examiner*—Sophia S Chen
(74) *Attorney, Agent, or Firm*—Morrison & Foerster LLP

(57) ABSTRACT

An image forming device including: an image carrier, being an endless belt, on which a toner image is to be formed; a resistance measuring unit operable to measure a distribution of electric resistances on a surface of the image carrier; a toner patch forming position determining unit operable to determine a position at which the toner patch is to be formed, according to a result of the measurement by the resistance measuring unit; a toner patch forming unit operable to form a toner patch on the image carrier surface at the position determined by the toner patch forming position determining unit; a toner patch detecting unit operable to detect the toner patch formed on the image carrier surface; and an image control unit operable to control a timing for forming the toner image on the image carrier surface, taking a position of the detected toner patch into account.

14 Claims, 11 Drawing Sheets

FIG.8

| BELT POSITION | ELECTRIC RESISTANCE | RESISTANCE VARIATION | RANK |
|---|---|---|---|
| $P_1$ | $R_1$ | $\triangle R_1$ | $M_6$ |
| $P_2$ | $R_2$ | $\triangle R_2$ | $M_5$ |
| ⋮ | ⋮ | ⋮ | ⋮ |
| $P_5$ | $R_5$ | $\triangle R_5$ | $M_1$ |
| $P_6$ | $R_6$ | $\triangle R_6$ | $M_2$ |
| ⋮ | ⋮ | ⋮ | ⋮ |
| $P_{16}$ | $R_{16}$ | $\triangle R_{16}$ | $M_3$ |
| ⋮ | ⋮ | ⋮ | ⋮ |
| $P_n$ | $R_n$ | $\triangle R_n$ | $M_4$ |

IMAGE FORMING DEVICE AND IMAGE FORMING METHOD INCLUDING FORMATION OF A TONER PATCH

This application is based on application No. 2006-160058 filed in Japan, the contents of which are hereby incorporated by reference.

BACKGROUND OF THE INVENTION (1) Field of the Invention

The present invention relates to an image forming device and an image forming method, and especially to an image forming device that includes an image carrier in the shape of an endless belt such as an intermediate transfer belt, and to an image forming method for the image forming device.

(2) Description of the Related Art

A what is called 4-cycle color printer uses a technology of transferring toner images of yellow (Y), magenta (M), cyan (C), and black (K) in layers onto an intermediate transfer belt via one photosensitive drum, so as to obtain a color image formed on a recording sheet or the like. In the 4-cycle color printer, a detecting unit detects, for example, a hole or a cut provided in the intermediate transfer belt so as to recognize a standard position of the belt. The timing at which the toner images are to be formed on the intermediate transfer belt is then controlled based on the recognized standard position.

In the above-described construction, however, a space for the hole or cut needs to be secured in the intermediate transfer belt. This would increase the intermediate transfer belt in width and thus would increase the image forming device in size. Also, providing such a hole or cut in the intermediate transfer belt would reduce the durability of the belt, making the belt easy to crack.

On the other hand, U.S. Pat. No. 5,499,092 discloses an image forming device that forms a toner patch on the intermediate transfer belt so that a detecting unit can detect the toner patch for recognition of the standard position of the belt. This construction eliminates the need to secure an extra space for a hole or a cut in the intermediate transfer belt, and therefore restricts the belt from becoming wider and the image forming device from enlarging. Also, it avoids crack formation in the belt since it avoids reduction in the belt durability.

Meanwhile, the intermediate transfer belt would have an electric resistance unevenness that is caused by a link of the belt generated during production or by a flaw generated during use. If a toner image is formed in an area having an electric resistance unevenness, a transfer density unevenness, which would reduce the image quality, occurs. Accordingly, to prevent the reduction of the image quality, it is preferable that the toner image is formed in an area that does not have an electric resistance unevenness.

The above-mentioned image quality reduction may occur even to the image forming device disclosed in U.S. Pat. No. 5,499,092, for the following reasons. In case the intermediate transfer belt has a toner patch thereon, a toner image should not be formed in an area having the toner patch. However, there may be a case where to avoid the toner patch, a toner image needs to be formed in an area that has an electric resistance unevenness.

SUMMARY OF THE INVENTION

The object of the present invention is therefore to provide an image forming device that does not increase in size, nor have belt cracks or image quality reduction, and an image forming method for the image forming device.

The above object is fulfilled by an image forming device including: an image carrier, being an endless belt, on which a toner image is to be formed; a resistance measuring unit operable to measure a distribution of electric resistances on a surface of the image carrier; a toner patch forming position determining unit operable to determine a position at which the toner patch is to be formed, according to a result of the measurement by the resistance measuring unit; a toner patch forming unit operable to form a toner patch on the image carrier surface at the position determined by the toner patch forming position determining unit; a toner patch detecting unit operable to detect the toner patch formed on the image carrier surface; and an image control unit operable to control a timing for forming the toner image on the image carrier surface, taking a position of the detected toner patch into account.

The above object is also fulfilled by an image forming method comprising the steps of: measuring a distribution of electric resistances on a surface of an image carrier which is an endless belt and on which a toner image is to be formed; determining a position at which the toner patch is to be formed, according to a result of the measurement in the electric resistance distribution measuring step; forming a toner patch on the image carrier surface at the position determined in the toner patch forming position determining step; detecting the toner patch formed on the image carrier surface; and controlling a timing for forming the toner image on the image carrier surface, taking a position of the detected toner patch into account.

With the above-stated construction, there is no need to provide a hole or a cut in the image carrier being an endless belt. This prevents the image carrier from increasing in the belt width and prevents the image forming device from increasing in size. This also avoids crack formation in the image carrier since it avoids reduction in the durability that occurs when a hole or a cut is provided in the image carrier. Also, according to this construction, first the distribution of electric resistances on the image carrier surface is measured, and then the position at which the toner patch is to be formed is determined according to the measurement result. This reduces the possibility that the toner image is formed in an area having an electric resistance unevenness, and thus reduces the possibility that the image quality is reduced due to the transfer density unevenness.

In the above-described image forming device, the toner patch forming position determining unit may determine a location of an image area based on a result of the measurement by the resistance measuring unit, and determines, as the toner patch forming position, a position that is included in an area other than the image area.

With the above-stated construction, it is easy to secure an area with no electric resistance unevenness as the image area, thus further reducing the possibility that the image quality is reduced due to the transfer density unevenness.

In the above-described image forming device, the toner patch forming position determining unit may determine the location of the image area such that the area other than the image area at least includes an area having a largest value of electric resistance variation in a belt running direction.

With the above-stated construction, it is further easy to secure an area with no electric resistance unevenness as the image area.

In the above-described image forming device, the toner patch forming position determining unit may calculate an average value among electric resistances in the image area, and determine, as the toner patch forming position, a position that belongs to the area other than the image area, and has an electric resistance that is closest to the calculated average value.

With the above-stated construction, it is easy to form a toner patch in good conditions, improving the detection accuracy of the toner patch detecting unit.

In the above-described image forming device, the resistance measuring unit may measure the distribution of electric resistances by sampling either current values under a constant voltage control or voltage values under a constant current control.

With the above-stated construction, it is possible to measure the distribution of the electric resistances with relative ease and accuracy.

The above-described image forming device may further comprise a transferring unit operable to transfer the toner image from the image carrier onto a paper sheet, wherein the sampling of current values or voltage values is performed via the transferring unit at a position on the image carrier surface from which the toner image is transferred onto the paper sheet.

With the above-stated construction, there is no need to provide separately a device for sampling the current or voltage values. This makes it possible to achieve the device with low cost and simple construction.

In the above-described image forming device, the resistance measuring unit measures the distribution of electric resistances on the image carrier surface either each time a predetermined number of paper sheets are printed or each time a predetermined environmental change occurs, the toner patch forming position determining unit re-determines the position at which the toner patch is to be formed, each time the resistance measuring unit measures the distribution of electric resistances, and each time the toner patch forming position determining unit re-determines the position, the toner patch forming unit re-forms the toner patch at the re-determined position.

With the above-stated construction, even in the case where the amount of electric resistance unevenness on the image carrier surface increases later, it is possible to form the toner image in an area with less electric resistance unevenness as possible, in correspondence with the state of the image carrier at the time of the formation.

In the above-described image forming device, an image control sensor may function as the toner patch detecting unit.

With the above-stated construction, there is no need to provide separately the toner patch detecting unit. This makes it possible to achieve the device with low cost and simple construction.

The above object is also fulfilled by an image forming device that, for formation of a color image, transfers toner images of different colors one by one onto an intermediate transfer member being rotated, the image forming device comprising: a resistance measuring unit operable to measure a distribution of electric resistances on a surface of the intermediate transfer member; a storage unit operable to store electric resistances of one circuit of the intermediate transfer member measured by the resistance measuring unit; a toner patch forming position determining unit operable to determine a position at which the toner patch is to be formed, according to the electric resistances of the intermediate transfer member stored in the storage unit; a toner patch forming unit operable to form a toner patch on the intermediate transfer member surface; a toner patch detecting unit that is arranged to face the intermediate transfer member, and detects the toner patch on the intermediate transfer member surface; and an image control unit operable to control timings for transferring toner images of different colors, one by one in layers, onto the intermediate transfer member surface, taking a position of the detected toner patch into account.

With the above-stated construction, there is no need to provide a hole or a cut in the intermediate transfer member. This prevents the intermediate transfer member from increasing in the belt width and prevents the image forming device from increasing in size. This also avoids crack formation in the intermediate transfer member since it avoids reduction in the durability that occurs when a hole or a cut is provided in the intermediate transfer member. Also, according to this construction, first the distribution of electric resistances on the intermediate transfer member surface is measured, and then the position at which the toner patch is to be formed is determined according to the measurement result. This reduces the possibility that the toner image is formed in an area having an electric resistance unevenness, and thus reduces the possibility that the image quality is reduced due to the transfer density unevenness.

In the above-described image forming device, the toner patch forming position determining unit may determine the position at which the toner patch is to be formed, based on the electric resistances of the intermediate transfer member stored in the storage unit, such that the toner images of the different colors are transferred one by one into an area that has a small electric resistance variation.

The above-stated construction, in which toner images of different colors can be superposed with high accuracy, prevents the reduction of the image quality.

The above-described image forming device may further comprise: one photosensitive drum; and a plurality of developers that are arranged to selectively face the photosensitive drum, wherein the toner patch forming unit forms a black toner patch, which is formed by one of the plurality of developers that uses a black toner, on the intermediate transfer member surface.

The above-stated construction, in which the toner patch is formed by a single color, not by stacking toners of a plurality of colors, makes it possible to form the toner patch in a short time. Also, forming the toner patch black improves the accuracy of detecting the toner patch.

BRIEF DESCRIPTION OF THE DRAWINGS

These and the other objects, advantages and features of the invention will become apparent from the following description thereof taken in conjunction with the accompanying drawings which illustrate a specific embodiment of the invention. In the drawings:

FIG. 8 shows the data table that contains the resistance information;

DESCRIPTION OF THE PREFERRED EMBODIMENT

The following describes an embodiment of the image forming device and image forming method of the present invention, with reference to the attached drawings.

<Construction of Image Forming Device>

Figure 1:
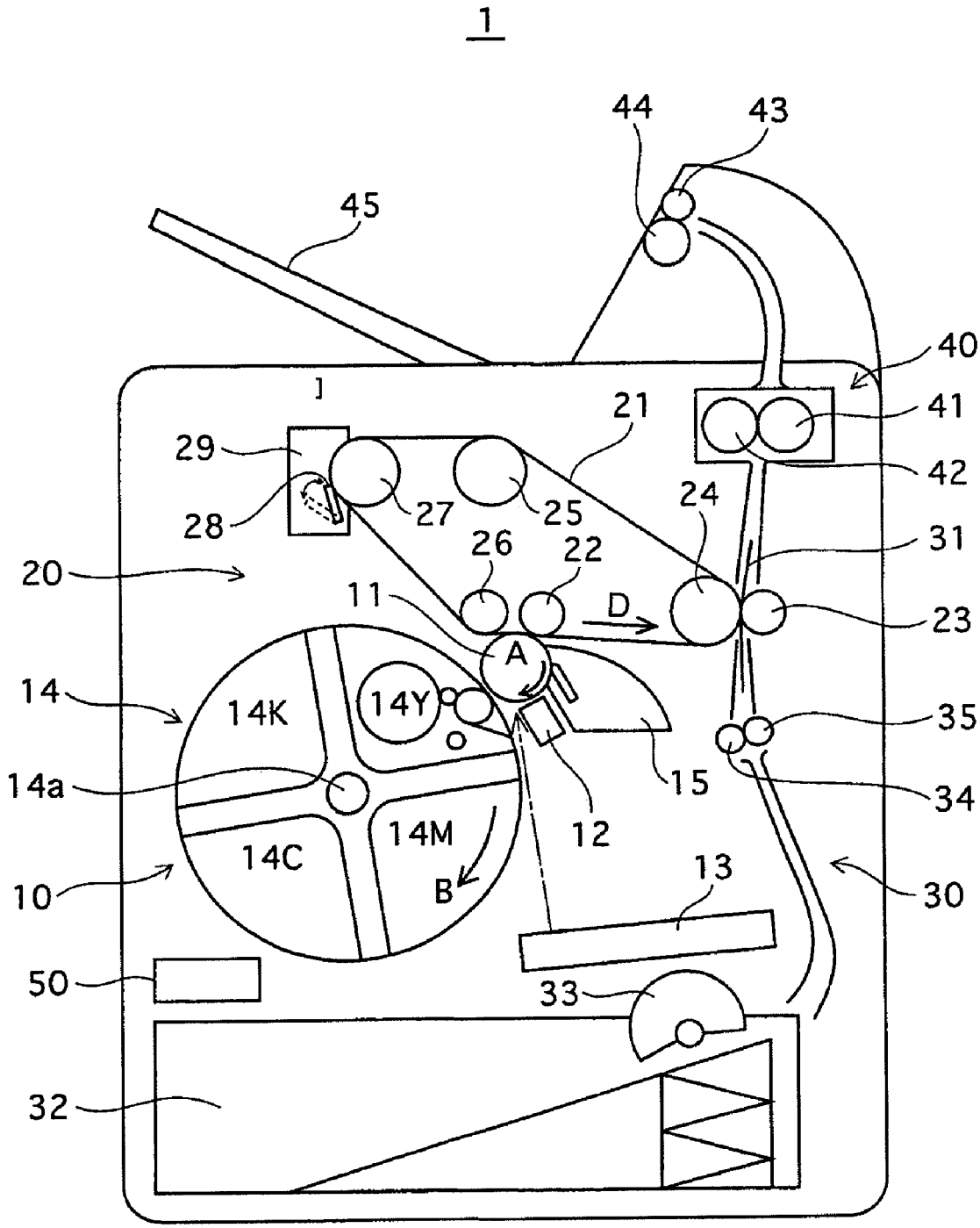
FIG. 1 shows an overall construction of the image forming device of the embodiment.

FIG. 1 shows an overall construction of the image forming device of the present embodiment. As shown in FIG. 1, the image forming device of the first embodiment is a what is called 4-cycle color printer 1 (hereinafter, merely referred to as "printer 1") that transfers toner images of respective colors of yellow (Y), magenta (M), cyan (C), and black (K) in layers onto an intermediate transfer belt via one image carrier, so as to obtain a color image formed on a recording sheet or the like.

The printer 1 includes an image forming unit 10, an intermediate transferring unit 20, a paper feeding unit 30, a fixing unit 40, and a control unit 50. The printer 1 performs a color printing using the colors of yellow (Y), magenta (M), cyan (C), and black (K), and a monochrome printing using the color of black (K), upon receiving an instruction from an external terminal apparatus (not illustrated) connected thereto via a network such as a LAN.

The image forming unit 10 includes a photosensitive drum 11, a charging apparatus 12, an exposing apparatus 13, a developing apparatus 14, and a cleaner apparatus 15. The image forming unit 10 forms a toner image on an intermediate transfer belt 21, and forms a toner patch 80 on the intermediate transfer belt 21 when it operates as a toner patch forming unit. The toner patch 80 is formed only by the black toner, not formed as layers of the colors.

The photosensitive drum 11 as a photoreceptor is in the shape of a cylinder on whose surface a photosensitive layer (not illustrated) is formed, and rotates in the direction indicated by the arrow A in FIG. 1.

The charging apparatus 12 operates to make the surface of the photosensitive drum 11 uniformly charged at a certain potential.

The exposing apparatus 13 forms an electrostatic latent image on the surface of the photosensitive drum 11 by radiating a laser beam, which corresponds to a time-series electric digital pixel signal of the image information, onto the surface of the photosensitive drum 11 to change the charging potential of the portion to be exposed.

The developing apparatus 14, including developers 14Y, 14M, 14C, and 14K that correspond respectively to the colors Y, M, C, and K, drives itself to rotate around a rotation axis 14*a* in the direction indicated by the arrow B in FIG. 1. The developers 14Y, 14M, 14C, and 14K are arranged to selectively face the photosensitive drum 11, and develop the electrostatic latent image on the surface of the photosensitive drum 11 using toners of colors respectively filled therein.

The cleaner apparatus 15 removes the remnant toners remaining on the surface of the photosensitive drum 11 after the transferring.

The intermediate transferring unit 20 includes an intermediate transfer belt 21, an initial transfer roller 22, a secondary transfer roller 23, a secondary transfer opposing roller 24, tension rollers 25 and 26, a cleaner opposing roller 27, and a cleaner apparatus 29 that includes a cleaner blade 28.

The intermediate transfer belt 21 is in the shape of an endless belt, is suspended with tension between the initial transfer roller 22, secondary transfer opposing roller 24, tension rollers 25 and 26, and cleaner opposing roller 27, and circles in the direction indicated by the arrow D in FIG. 1 as the driving unit (not illustrated) drives the secondary transfer opposing roller 24 to rotate. The intermediate transfer belt 21 is made of a semiconductor resin, and is typically formed to be $10^6\Omega/\square$ to $10^{15}\Omega/\square$ in the surface resistivity, $10^6\Omega\cdot$cm to $10^{15}\Omega\cdot$cm in the volume resistivity, and 50 μm to 200 μm in thickness.

The initial transfer roller 22 is arranged to face the photosensitive drum 11 with the intermediate transfer belt 21 in between such that an initial transfer position is located between the initial transfer roller 22 and the photosensitive drum 11. That is to say, the initial transferring unit is composed of the photosensitive drum 11 and the initial transfer roller 22.

The secondary transfer roller 23 and the secondary transfer opposing roller 24 are arranged to face each other with the intermediate transfer belt 21 in between such that the secondary transfer position is located between the secondary transfer roller 23 and the secondary transfer opposing roller 24. That is to say, the secondary transferring unit is composed of the secondary transfer roller 23 and the secondary transfer opposing roller 24.

The cleaner apparatus 29 causes the cleaner blade 28 to contact the surface of the intermediate transfer belt 21 to collect the remnant toners from the surface, and to store the collected toners in the cleaner apparatus 29. The cleaner blade 28 is kept to be away from the surface of the intermediate transfer belt 21 while the toner image is formed on the intermediate transfer belt 21, and is contacted to the surface of the intermediate transfer belt 2i after the toner image is transferred from the intermediate transfer belt 21 to the sheet 31.

The cleaner blade 28 is held at a position a distance away from the surface of the intermediate transfer belt 21 at the timing when the toner patch 80 passes the cleaning position, regardless of whether the toner image has been formed on the intermediate transfer belt 21. With this construction, the toner patch 80 is not removed from the surface of the intermediate transfer belt 21. To re-form the toner patch 80, the cleaner blade 28 is contacted to the surface of the intermediate transfer belt 21 to remove the cleaner blade 28, and then a new toner patch 80 is formed.

The paper feeding unit 30 includes a paper feed cassette 32 for storing sheets 31 as a transfer material, a pickup roller 33 for picking up a sheet 31 from the paper feed cassette 32, and a pair of resist rollers 34, 35 for transporting the picked up sheet 31 to the secondary transfer position. The sheet 31 is transported to the secondary transfer position at the timing when the secondary transfer is performed.

The fixing unit 40 includes a pair of fixing rollers 41 and 42 that are arranged to face each other, and rotate while being in contact with each other. Each of the fixing rollers 41 and 42 is provided with an internal heater (not illustrated) such that when the sheet 31 passes between the fixing rollers 41 and 42, the sheet 31 is pressed at a high temperature. This enables the toner to be fusion-bonded with the sheet 31 and fixed thereto, forming the toner image. The sheet 31 to which the toner has been fixed is ejected into an outlet tray 45 by eject rollers 43 and 44.

Figure 2:
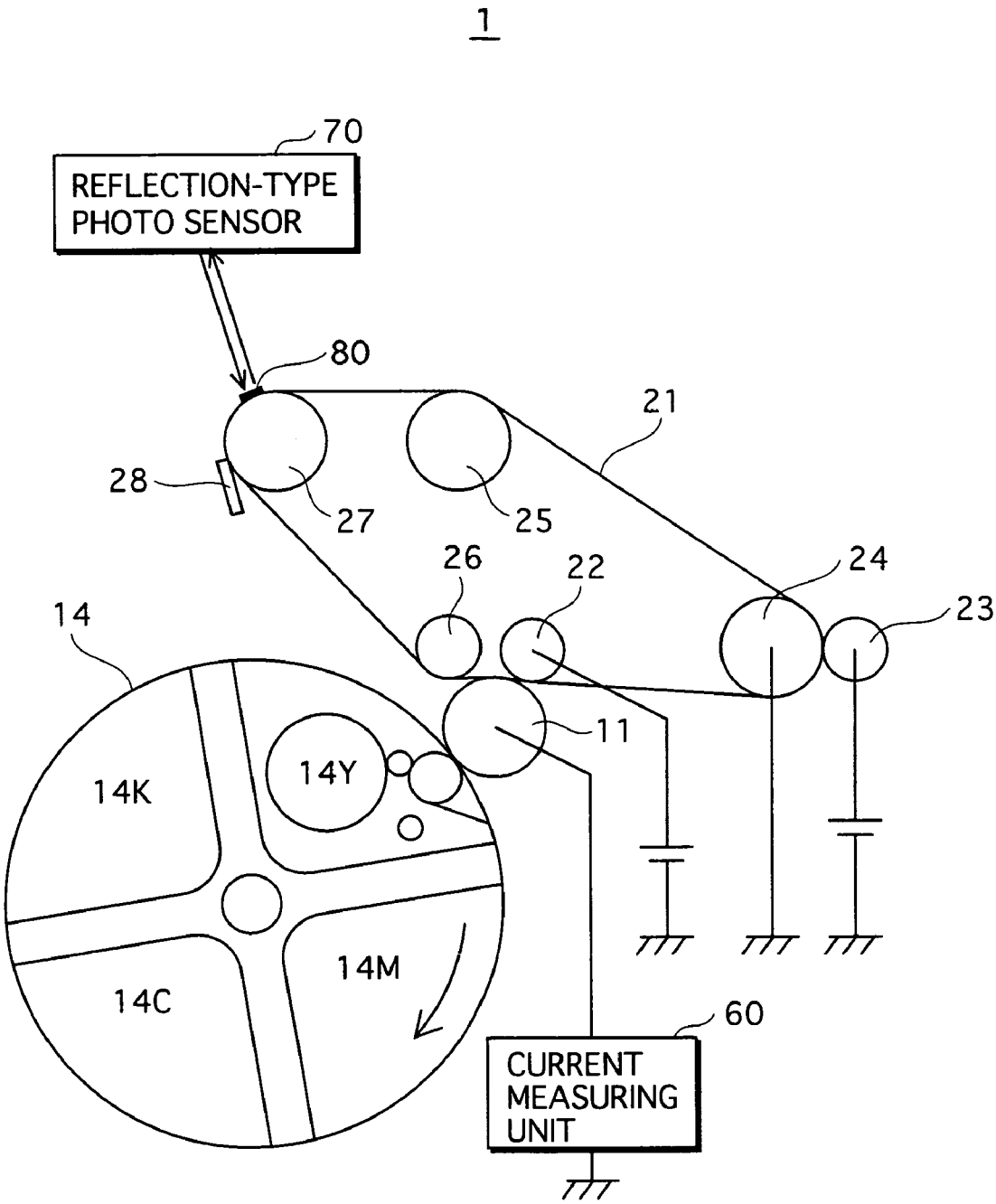
FIG. 2 shows the construction of the principal part of the image forming device in the embodiment.

FIG. 2 shows the construction of the principal part of the image forming device in the present embodiment. As shown in FIG. 2, the printer 1 includes a current measuring unit 60 as a resistance measuring unit for measuring resistance unevenness of the intermediate transfer belt 21, and a reflection-type photo sensor 70 as a toner patch detecting unit for detecting the toner patch 80 on the intermediate transfer belt 21.

The current measuring unit 60, electrically connected with the photo sensitive drum 11, measures the electric resistance of the intermediate transfer belt 21 based on the information that is obtained during an auto transfer bias control. More specifically, the current measuring unit 60, under a constant voltage control performed by the control unit 50, samples current values of the intermediate transfer belt 21 via the photosensitive drum 11. The current value data, which is a measurement result of the electric resistance, is transmitted to the control unit 50.

Figure 3:
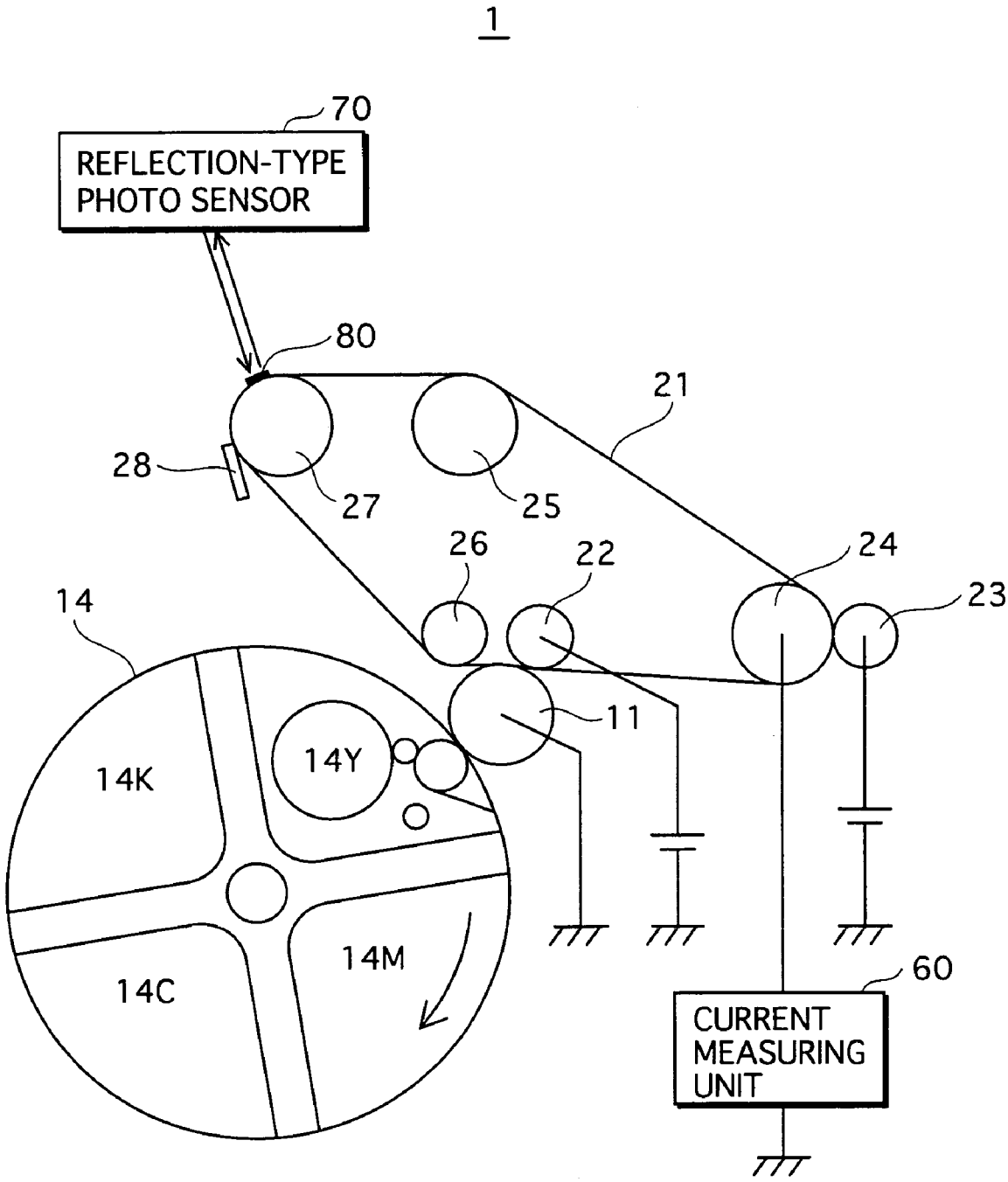
FIG. 3 shows the construction of the principal part of an image forming device in a modification.

The current measuring unit 60 may sample current values of the intermediate transfer belt 21 via a member or a device other than the initial transfer roller 22. As one example, FIG. 3 shows the construction of the principal part of an image forming device in a modification. As shown in FIG. 3, the current measuring unit 60 of this modification is electrically connected with the secondary transfer opposing roller 24. The current measuring unit 60 samples current values of the intermediate transfer belt 21 via the secondary transfer opposing roller 24. The current value data is transmitted to the control unit 50. When the current values are sampled, the secondary transfer opposing roller 24 is under a constant voltage control performed by the control unit 50.

The current measuring unit 60 is not limited to the construction in which the current values of the intermediate transfer belt 21 are sampled via an existent member such as the initial transfer roller 22 or the secondary transfer opposing roller 24. For example, a dedicated member for measuring the current value of the intermediate transfer belt 21 maybe provided independently, and the current values may be sampled via the dedicated member.

The reflection-type photo sensor 70 is a sensor for detecting the toner patch 80 on the intermediate transfer belt 21, and is arranged to face the intermediate transfer belt 21. The reflection-type photo sensor 70 is also used as an AIDC (Auto Image Density Control) sensor for image control. It should be noted here that the toner patch detecting unit is not limited to the reflection-type photo sensor 70, but may be any sensor in so far as it can detect the toner patch 80. The toner patch detecting unit may be provided separately from the image control sensor.

Figure 4:
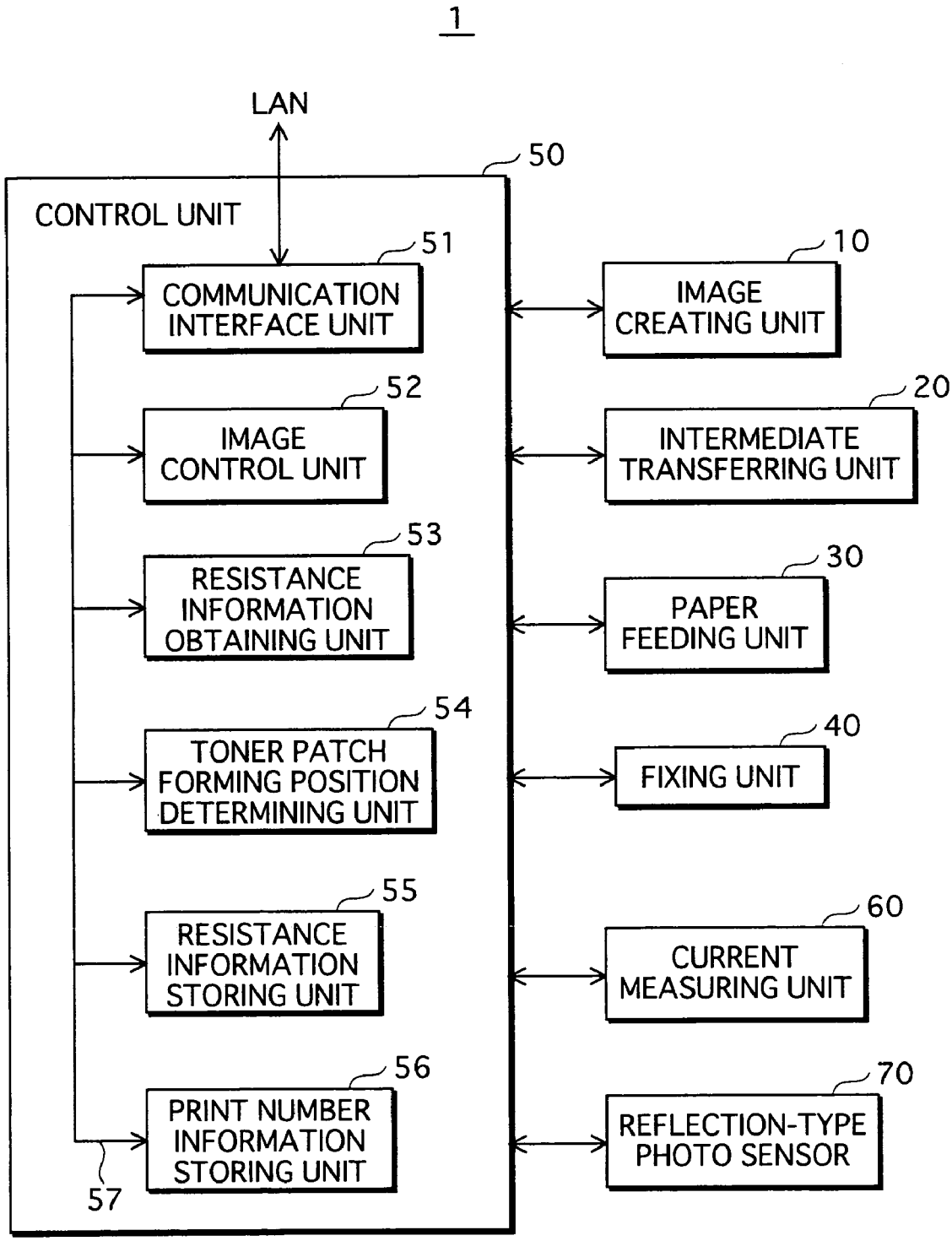
FIG. 4 is a block diagram showing the construction of the control unit.

FIG. 4 is a block diagram showing the construction of the control unit. As shown in FIG. 4, the control unit 50 includes, as major constituent elements, a communication interface unit 51, an image control unit 52, a resistance information obtaining unit 53, a toner patch forming position determining unit 54, a resistance information storing unit 55 as a storage unit, and a print number information storing unit 56. These units 51 to 56 can communicate with each other via a bus 57.

The communication interface unit 51 is an interface achieved in a LAN card, a LAN board or the like and is used to connect with a LAN.

The image control unit 52 controls the overall operation of the image forming unit 10, the intermediate transferring unit 20 and the like to realize a smooth printing operation. As one control for this purpose, the image control unit 52 controls the timing at which the toner image is formed on the intermediate transfer belt 21, taking a position of the detected toner patch 80 into account.

The resistance information obtaining unit 53 obtains the resistance information as the measurement result of the electric resistance distribution, based on the current values sampled by the current measuring unit 60. More specifically, the resistance information obtaining unit 53 calculates electric resistances ($R_1$–$R_n$) at positions ($P_1$–$P_n$) on the surface of the intermediate transfer belt 21, from the sampled current values, further calculates resistance variations ($\Delta R_1$–$\Delta R_n$) from the electric resistances ($R_1$–$R_n$), and further determines ranks ($M_1$–$M_n$) that indicate levels of the resistance unevenness, based on the resistance variations ($\Delta R_1$–$\Delta R_n$). This will be described in details later.

The toner patch forming position determining unit 54 determines the position at which the toner patch 80 is to be formed based on the resistance information obtained by the resistance information obtaining unit 53 such that toner images of respective colors are transferred in sequence onto an area that is small in the variation of the electric resistance. How to determine the position at which the toner patch 80 is to be formed will be described later.

The resistance information storing unit 55 stores a data table whose example is shown in FIG. 8. The data table contains the resistance information such as belt positions ($P_1$–$P_n$), electric resistances ($R_1$–$R_n$), resistance variations ($\Delta R_1$–$\Delta R_n$), and ranks ($M_1$–$M_n$), and stores electric resistances of one circuit of the intermediate transfer belt 21. The data table will be described in details later.

The print number information storing unit 56 calculates the total number of prints Ct based on the number of prints C that is counted per print job. The print number information storing unit 56 stores the calculated total number of prints Ct as the print number information.

<Operation of Image Forming Device>

Upon receiving an image signal for a print job from an external terminal device (not illustrated), the control unit 50 generates image data by performing necessary processes on the received image signal, and converts the image data into a drive signal for driving, the exposing apparatus 13. Upon receiving the drive signal from the control unit 50, the exposing apparatus 13 radiates a laser beam (for image forming) onto the surface of the photosensitive drum 11 to exposure-scan thereof. When this exposure-scanning is performed, the surface of the photosensitive drum 11 is cleaned by the cleaner apparatus 15, the electricity is removed from the surface by an eraser lamp (not illustrated), and the surface is uniformly charged by the charging apparatus 12.

The electrostatic latent image on the surface of the photosensitive drum 11 is developed into a toner image of a color by one of the developers 14Y, 14M, 14C, and 14K. When the electrostatic latent image is developed into toner images of all colors of the developers 14Y, 14M, 14C, and 14K, the toner images are layered on the intermediate transfer belt 21 at the initial transfer position so that a color image is reproduced. The control unit 50 controls, taking a position of the detected toner patch 80 into account, the timing at which each toner image is formed so that the toner images are layered appropriately.

On the other hand, the sheet 31 is transported from the paper feed cassette 32 to the secondary transfer position. At the secondary transfer position, the toner image is transferred from the intermediate transfer belt 21 onto the surface of the sheet 31 by the electrostatic action of the secondary transfer roller 23. The sheet 31 on which the toner image has been transferred is transported from the secondary transfer position to the fixing unit 40, where the toner image is fixed onto the sheet 31 by the fixing rollers 41 and 42, and then the sheet 31 is ejected into the outlet tray 45.

<Toner Patch Forming Process>

The toner patch forming process, in which the toner patch 80 is formed onto the intermediate transfer belt 21, is performed when the intermediate transfer belt 21 is a new one and no toner patch has been formed thereon, or when a toner patch is re-formed on the intermediate transfer belt 21 (by removing an old toner patch and re-forming a toner patch).

The following describes the toner patch forming process.

Figure 5:
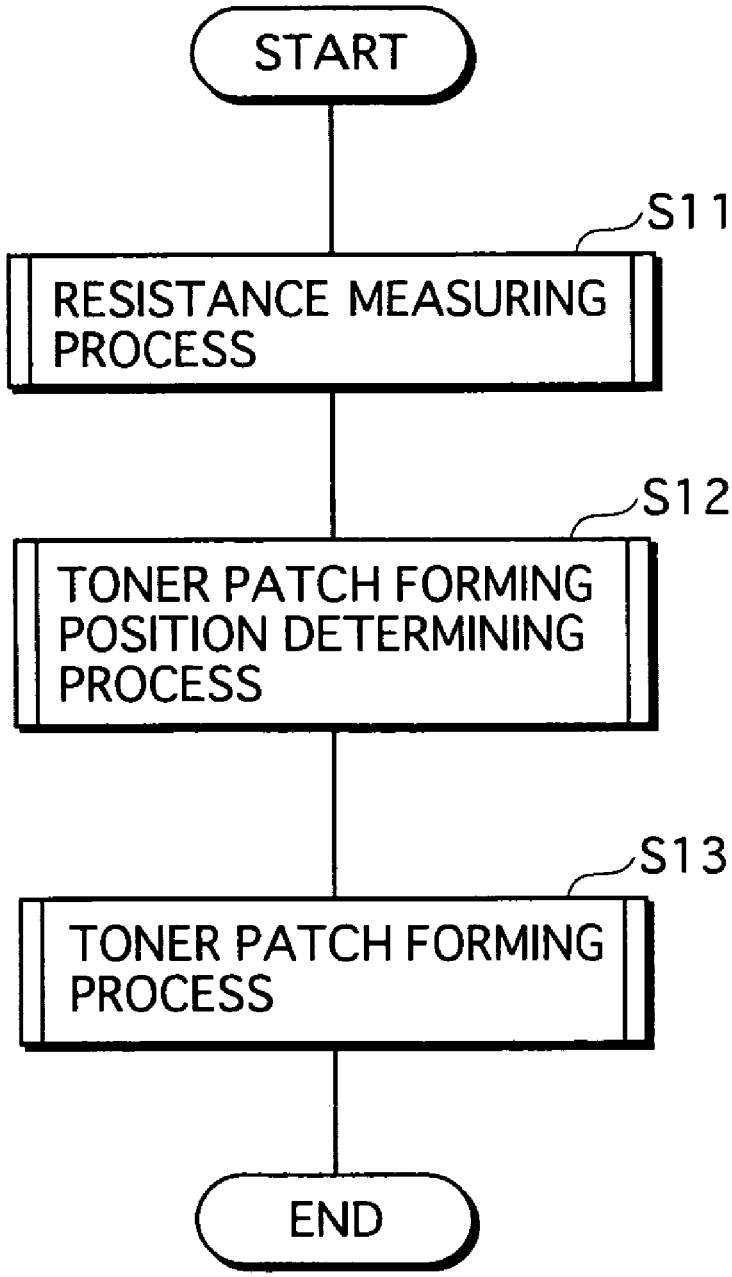
FIG. 5 is a flowchart showing the procedure of the main routine of the toner patch forming process.

FIG. 5 is a flowchart showing the procedure of the main routine of the toner patch forming process. As shown in FIG. 5, the toner patch forming process starts with the resistance measuring process in which the resistance information is obtained from the intermediate transfer belt 21 (step S11). Next, in the toner patch forming position determining process, the position at which the toner patch is to be formed is determined based on the resistance information (step S12). Then, in the toner patch forming process, the toner patch is formed (step S13).

Figure 6:
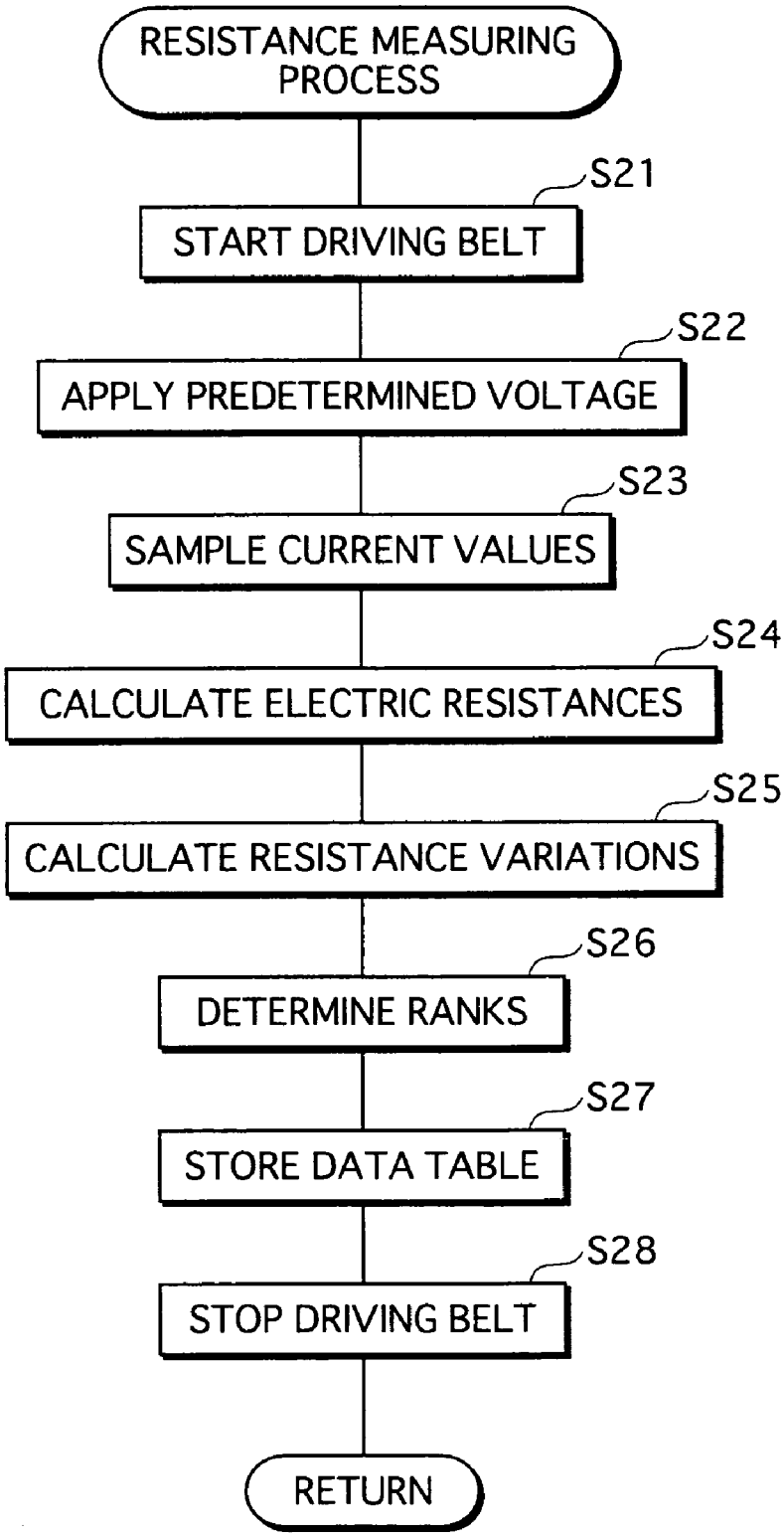
FIG. 6 is a flowchart showing the procedure of the resistance measuring process.

FIG. 6 is a flowchart showing the procedure of the resistance measuring process. As shown in FIG. 6, in the resistance measuring process, first the intermediate transfer belt 21 is started to be driven (step S21), and a predetermined voltage is applied to the initial transfer roller 22 (step S22).

The current measuring unit 60 then samples the current values of the intermediate transfer belt 21 via the photosensitive drum 11 (step S23). More specifically, first a position on the surface of the intermediate transfer belt 21 from which the sampling should start is defined as a belt position $P_1$. Then, using the belt position $P_1$ as the origin, the circuit of the surface of the intermediate transfer belt 21 is divided into n equal parts. Then the belt positions $P_1$–$P_n$ are assigned toward downstream in the stated order to the positions demarcating the n equal parts. The current values are sampled at the belt positions $P_1$–$P_n$.

For example, the current value at the belt position $P_2$ is equivalent to a current value that is measured when t seconds pass from the start of the measurement. Here, the "t" is represented by t=a/nV, where "V" denotes the rotation speed of the intermediate transfer belt 21, and "a" denotes the circuit length of the surface of the intermediate transfer belt 21. Similarly, the current value at the belt position $P_3$ is equivalent to a current value that is measured when 2t seconds pass from the start of the measurement. In this way, the current values are sampled at the belt positions $P_1$–$P_n$.

The current value sampling method is not limited to the above-described one. For example, first the number of rotations of the secondary transfer opposing roller 24, which drives the rotation of the intermediate transfer belt 21, is measured, and then the current values may be sampled at the belt positions $P_1$–$P_n$ each time the measured number of rotations reaches a value that is obtained by dividing, by "n", the number of rotations corresponding to one rotation of the circuit of the belt.

Figure 7:
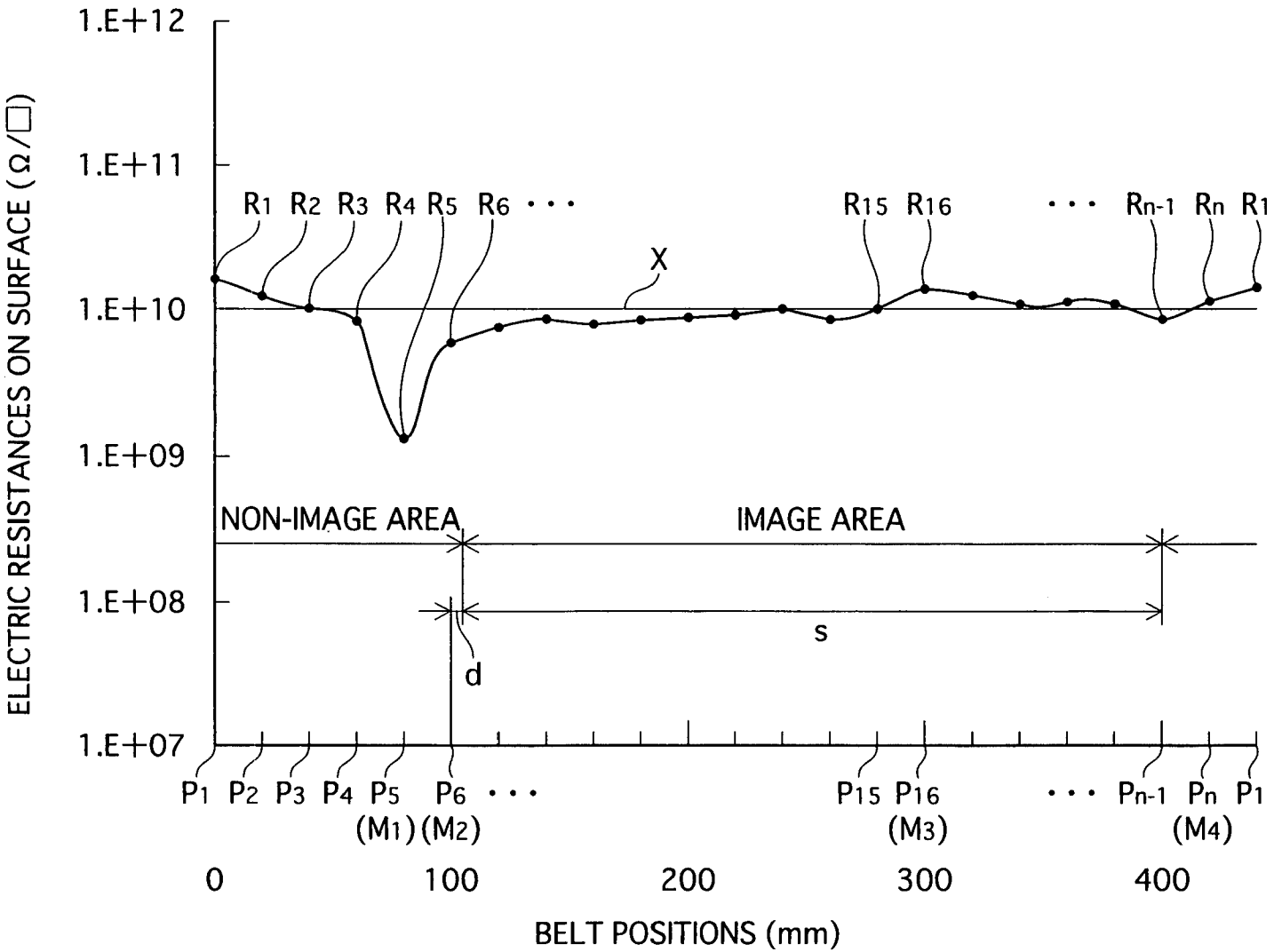
FIG. 7 shows an example of electric resistance distribution on the intermediate transfer belt.

In the next step of the flowchart, the resistance information obtaining unit 53 calculates electric resistances $R_1$–$R_n$ at the belt positions $P_1$–$P_n$, from the sampled current values (step S24). In the graph of FIG. 7, the horizontal axis represents the belt positions $P_1$–$P_n$ in one circuit of the surface of the intermediate transfer belt 21, and the vertical axis represents the electric resistances on the surface of the intermediate transfer belt 21. In the example shown in FIG. 7, the intermediate transfer belt 21 is 440 mm in the circuit length and 20 mm in the distance between the belt positions $P_1$–$P_n$, and n=22. And it is found from the graph that the area extending from belt position $P_4$ to belt position $P_6$ includes a large resistance unevenness.

Next, the resistance information obtaining unit 53 calculates resistance variations $\Delta R_1$–$\Delta R_n$, at the belt positions $P_1$–$P_n$, based on the electric resistances $R_1$–$R_n$ (step S25). More specifically, the resistance information obtaining unit 53 calculates, for example, each of the resistance variations $\Delta R_1$–$\Delta R_n$ as a difference between resistances that are adjacent to each other toward upstream (for example, it calculates a resistance variation $\Delta R_2$ as a difference between an electric resistance $R_1$ and an electric resistance $R_2(|R_1-R_2|)$, and a resistance variation $\Delta R_1$ as a difference between an electric resistance $R_n$ and an electric resistance $R_1(|R_n-R_1|)$. The method of calculating the resistance variations $\Delta R_1$–$\Delta R_n$ is not limited to this, but may be, for example, a method of calculating the average value among the electric resistances $R_1$–$R_2$, obtaining differences between the average value and each of the electric resistances $R_1$–$R_2$, and determining the obtained differences as the resistance variations $\Delta R_1$–$\Delta R_n$. Also, each of the resistance variations $\Delta R_1$–$\Delta R_n$may be calculated as a difference between resistances that are adjacent to each other toward downstream (for example, a resistance variation $\Delta R_2$ is calculated as a difference between an electric resistance $R_3$ and an electric resistance $R_2(|R_3-R_2|)$.

In the next step of the flowchart, the resistance information obtaining unit 53 determines the ranks $M_1$–$M_n$ that indicate levels of the resistance unevenness at the belt positions $P_1$–$P_n$, based on the resistance variations $\Delta R_1$–$\Delta R_n$(step S26). More specifically, for example, the resistance variations $\Delta R_1$–$\Delta R_n$ are arranged in the order from the largest to the smallest, and determines the resistance variations $\Delta R_1$–$\Delta R_n$ after the arrangement as the ranks $M_1$–$M_n$, respectively.

FIG. 8 shows a data table that contains the resistance information. The belt positions $P_1$–$P_n$ and the resistance information, such as electric resistances $R_1$–$R_n$, resistance variations $\Delta R_1$–$\Delta R_n$, and ranks $M_1$–$M_n$ respectively at the belt positions $P_1$–$P_n$, are written into a data table as shown in FIG. 8, and the data table is stored in the resistance information storing unit 55 (step S27).

After this, the belt is stopped being driven (step S28), and the control returns to the main routine.

Figure 9:
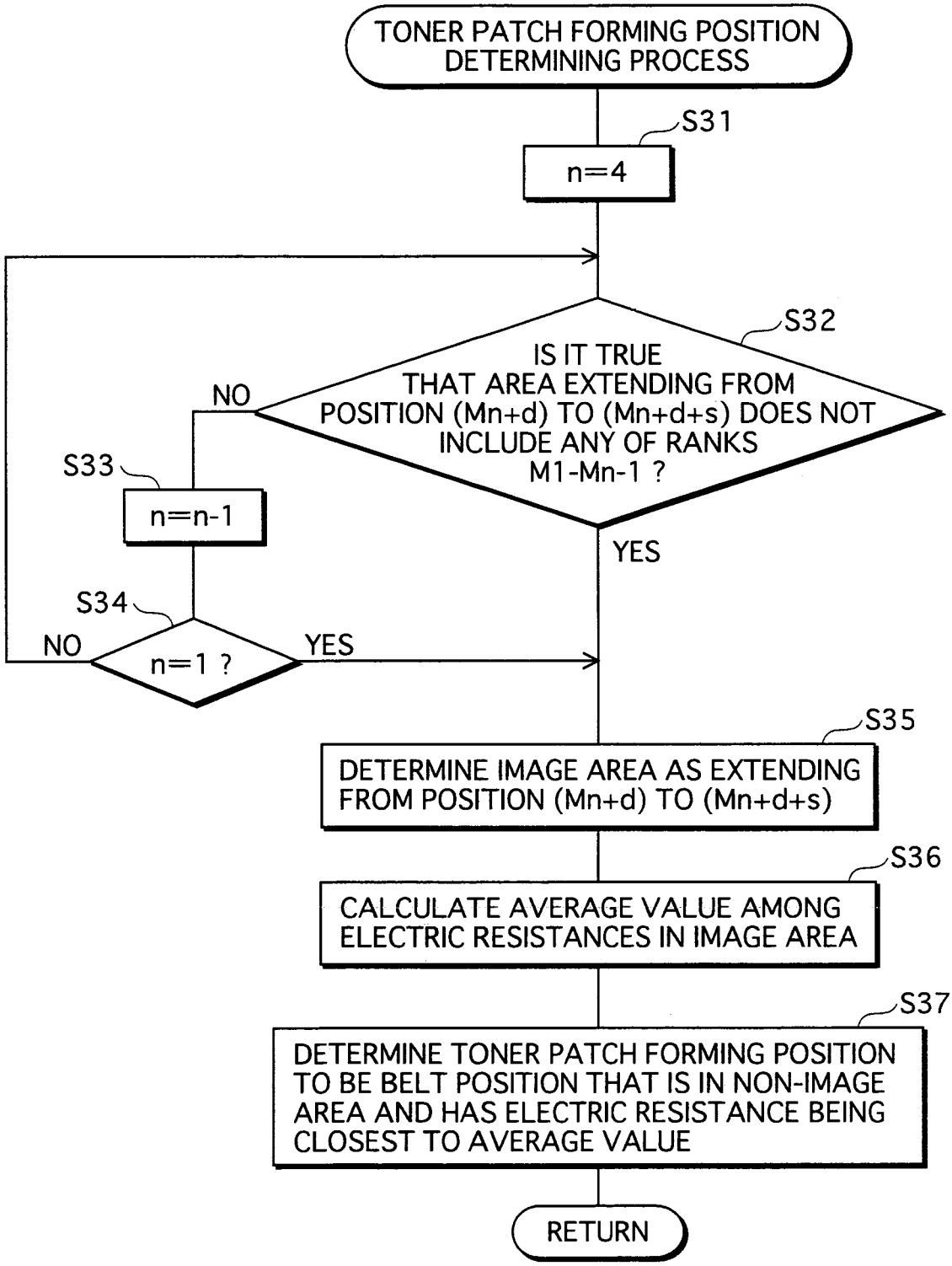
FIG. 9 is a flowchart showing the procedure of the toner patch forming position determining process.

FIG. 9 is a flowchart showing the procedure of the toner patch forming position determining process. In the toner patch forming position determining process, the location of the image area is determined based on the measurement result of the electric resistance distribution and the size of the toner image, and a position that is included in an area other than the image area is determined as the toner patch forming position.

More specifically, the process secures an image area that does not include any of four belt positions which correspond to the four highest ranks of the resistance unevenness, and sets the position, at which the toner patch is to be formed, to a belt position in an image not-forming area that is as close to an image forming area as possible.

As shown in FIG. 9, the value "n" is set to 4 (n=4) (step S31), and it is judged whether or not it is true that an area extending from position ($M_4$+d) to position ($M_4$+d+s) does not include any of belt positions corresponding to ranks $M_1$, $M_2$, and $M_3$ (in the example shown in FIG. 7, belt positions $P_5$, $P_6$, and $P_{16}$ corresponding to ranks $M_1$, $M_2$, and $M_3$, respectively) (step S32).

Here, the position ($M_4$+d) indicates a position that is downstream of the belt position $P_n$ that corresponds to the rank $M_4$ by a predetermined distance d [mm]. It is possible to secure an image area that does not include the belt position $P_n$, by setting the starting position of the image area to a position that is downstream of the belt position $P_n$. It should be noted here that the belt position $P_n$ is isolated from the image area by the separation of the starting position of the image area from the belt position $P_n$ by the predetermined distance d [mm].

Also, the position ($M_4$+d+s) indicates a position that is downstream of the belt position $P_n$ that corresponds to the rank $M_4$ by a predetermined distance d [mm] and further by a predetermined measurement s [mm]. The predetermined measurement s [mm] is a measurement of the sheet 31 along the circuit of the intermediate transfer belt 21. The image area requires a width that is equal to or larger than the predetermined measurement s [mm] along the circuit of the intermediate transfer belt 21.

For example, when the sheet 31 is A4 in size, the measurement of the sheet 31 along the circuit of the intermediate transfer belt 21 is 300 [mm]. In this case, the image area requires at least 300 [mm] along the circuit of the intermediate transfer belt 21.

When an area extending from position ($M_4$+d) to position ($M_4$+d+s) does not include any of belt positions corresponding to ranks $M_1$, $M_2$, and $M_3$, it is possible to secure an image area that does not include any of the belt positions that correspond to the ranks $M_1$–$M_4$.

In the case of the example shown in FIG. 7, however, an area extending from position ($M_4$+d) to position ($M_4$+d+s) includes belt positions $P_5$ and $P_6$ corresponding respectively to ranks $M_1$ and $M_2$ ("NO" in step S32). When this happens, it is not possible to secure an image area that does not include any of the belt positions corresponding to ranks $M_1$–$M_4$.

Accordingly, the value "n" is set to 3 (n=3) (step S33), it is judged that the value "n" is not 1 ("NO" in step S34), and the control returns to step S32 to judge whether or not it is true that an area extending from position ($M_3$+d) to position ($M_3$+d+s) does not include any of of the belt positions corresponding to ranks $M_1$ and $M_2$ (step S32).

In the case of the present example, however, an area that extending from position ($M_3$+d) to position ($M_3$+d+s) includes belt positions $P_5$ and $P_6$ corresponding respectively to ranks $M_1$ and $M_2$ ("NO" in step S32). Accordingly, the value "n" is set to 2 (n=2) (step S33), it is judged that the value "n" is not 1 ("NO" in step S34), and the control returns to step S32 to judge whether or not it is true that an area that extends from position ($M_2$+d) to position ($M_2$+d+s) does not include a belt position corresponding to rank $M_1$ (step S32).

It is judged positively in this round since an area extending from position ($M_2$+d) to position ($M_2$+d+s) does not include belt position $P_5$ corresponding to rank $M_1$ ("YES" in step S32). This indicates that it is possible to secure an image area that does not include the belt positions $P_5$ and $P_6$, at which the resistance unevenness is the largest and the second largest, respectively. Therefore, the area that extends from position ($M_2$+d) to position ($M_2$+d+s) is determined as the image area (step S35)

Then the resistance information obtaining unit 53 calculates the average value among the electric resistances in the image area (step S36). In this calculation of the average value, only the electric resistances in the image area are used, and the electric resistances in the non-image area (the area excluding the image area) are not used. The line X shown in FIG. 7 indicates the average value among the electric resistances in the image area.

Next, the average value among the electric resistances in the image area is compared with the electric resistance at each belt position in the non-image area, and the belt position having an electric resistance that is closest to the average value is determined as the toner patch forming position (step S37). In the example shown in FIG. 7, belt position $P_3$ has an electric resistance that is closest to the average value. As a result, the belt position $P_3$ is determined as the toner patch forming position.

Figure 10:
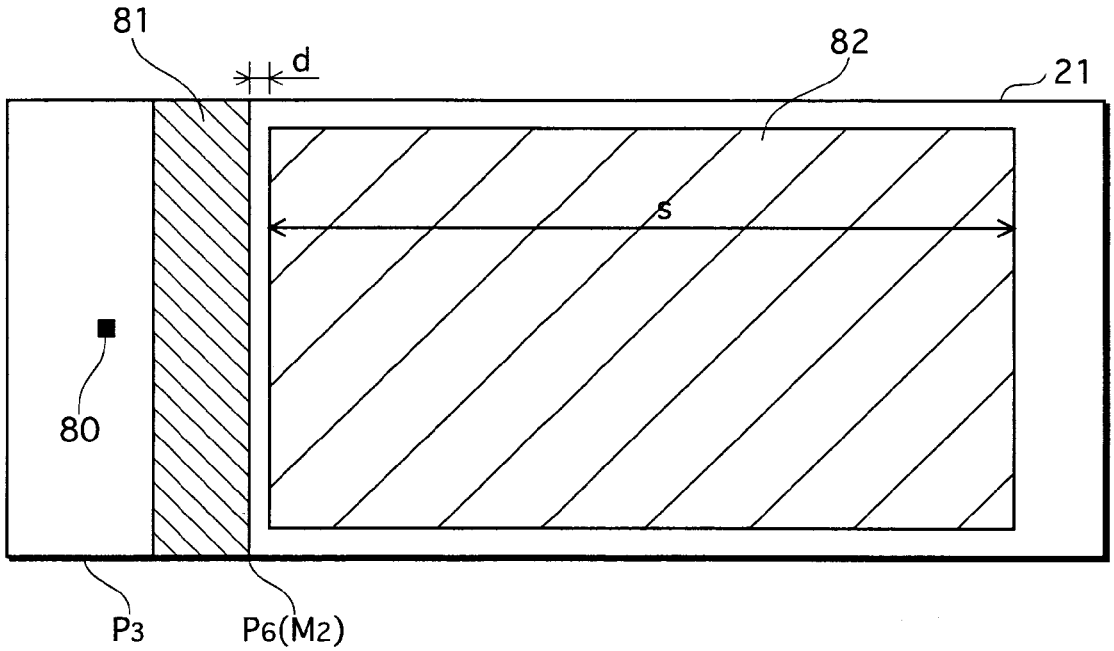
FIG. 10 illustrates the toner patch forming position on the surface of the intermediate transfer belt.

FIG. 10 illustrates the toner patch forming position on the surface of the intermediate transfer belt. As shown in FIG. 10, the starting position of the image area 82 is position ($M_2$+d) that is downstream of belt position $P_6$, which has the second largest resistance variation, by the predetermined distance d [mm],and the ending position of the image area 82 is position ($M_2$+d+s) that is downstream of the starting position by the predetermined measurement s [mm].

On the other hand, the non-image area is an area excluding the image area that extends from position ($M_2$+d) to position ($M_2$+d+s). The toner patch 80 is formed at belt position $P_3$ that is in the non-image area and has an electric resistance being closest to the average value among the electric resistances in the image area. The belt positions $P_5$ and $P_6$ that correspond respectively to ranks $M_1$ and $M_2$ are included in a link (weld) 81 of the intermediate transfer belt 21.

In the above description, judgment on the value "n" starts with "4" (n=4) in step S31. This means that four belt positions corresponding to the four highest ranks of the resistance unevenness (four belt positions corresponding to ranks $M_1$–$M_4$) are recognized as the belt positions at which the resistance unevenness exists. This is because it is thought that securing an image area that does not include any of the belt positions corresponding to the ranks $M_1$–$M_4$ is enough to achieve the purpose of the present invention, when the circuit length of the intermediate transfer belt 21 or the like is taken into account.

Not limited to the above-described example in which judgment on the value "n" starts with "4" (n=4), judgment on the value "n" may start with any value in the range from "2" (n=2) to "n−1" (n=n−1). For example, judgment on the value "n" may start with "n−1" (n=n−1) in step S31 when it is desired to secure an image area such that it includes as less belt positions corresponding to higher ranks of the resistance unevenness as possible.

Meanwhile, it is desirable that the resistance measuring process, the toner patch forming position determining process, and the toner patch forming process are performed in one succession. This is because, for example, if the intermediate transfer belt 21 is stopped being driven after the resistance measuring process and then re-started, the speed of the intermediate transfer belt 21 becomes unstable at the start-up, which changes the correspondence between the resistance unevenness and the belt positions, and degrades the accuracy of the toner patch forming position determining process.

The control unit 50 determines whether to perform the toner patch forming process. The following describes the process of determining the timing at which the toner patch 80 is to be re-formed on the intermediate transfer belt 21.

Figure 11:
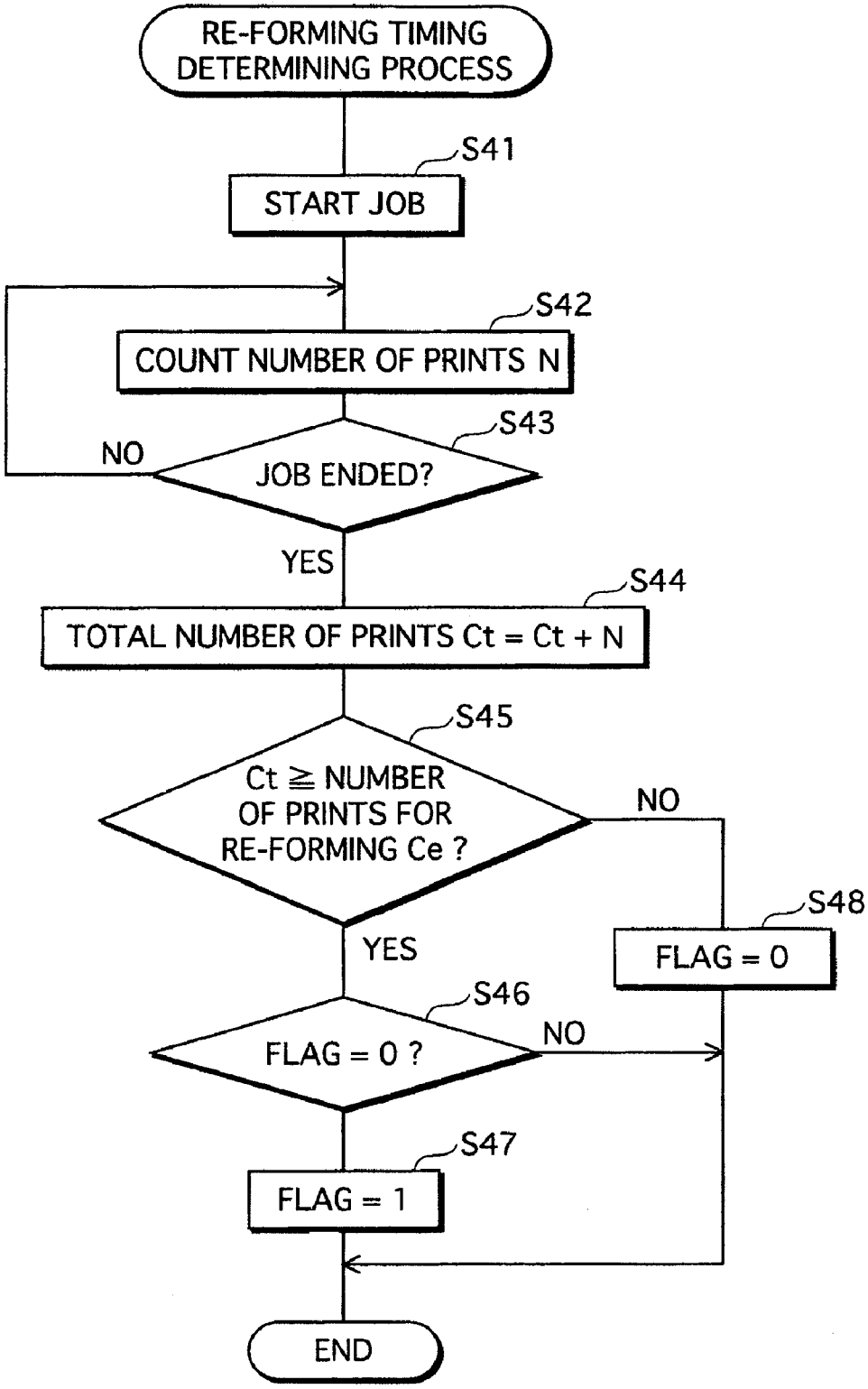
FIG. 11 is a flowchart showing the procedure of the re-forming timing determining process.

FIG. 11 is a flowchart showing the procedure of the re-forming timing determining process. As shown in FIG. 11, as a print job is started (step S41), the number of prints N is counted (step S42), and if the print job is ended ("YES" in step S43), the counted number of prints N is added to the total number of prints Ct stored in the print number information storing unit 56, and the total number of prints Ct is updated to the value obtained by adding N to Ct (step S44).

It is then judged whether the total number of prints Ct is equal to or larger than the number of prints for re-forming Ce (step S45). Here, the number of prints for re-forming Ce is the number of prints that is expected to require the re-forming of the toner patch, and is preliminarily obtained through experiments and is stored in an internal ROM (not illustrated) or the like.

The number of prints for re-forming Ce is set to, for example, 10,000, in accordance with the proper ties of the printer 1. It should be noted here that the number of prints for re-forming Ce may be a varying value. For example, the number of prints for re-forming Ce may be set to 100 up to 1,000 prints after the start of use of the printer 1, and set to 1,000 thereafter.

If it is judged that the total number of prints Ct is equal to or larger than the number of prints for re-forming Ce ("YES" in step S45), it is judged whether the value of the flag stored in the flag storing unit is "0" (step S46).

If it is judged that the value of the flag is "0" ("YES" in step S46), the flag is set to "1" (step S47), and the process is ended.

Back to step S45, if it is judged that the total number of prints Ct is smaller than the number of prints for re-forming Ce ("NO" in step S45), the flag is set to "0" (step S48), and the process is ended.

The above-described re-forming timing determining process is performed each time a print job is performed, and if the number of prints reaches or exceeds a predetermined value, the flag is set to "1" to indicate that the re-forming timing has come.

<Modifications>

Up to now, the image forming device of the present invention has been described specifically through an embodiment. However, the technical scope of the present invention is not limited to the above-described embodiment.

For example, the image forming device of the present invention is not limited to what is called 4-cycle image forming device, but may be what is called tandem image forming device. Even a tandem image forming device can form toner images on an area that does not include the resistance unevenness, producing the advantageous effect of reducing the transfer density unevenness, preventing the image quality reduction.

Also, not limited to a construction in which first the location of the image area is determined, and then a toner patch forming position is determined to be in a non-image area, the image forming device of the present invention may have a construction in which first the location of the non-image area is determined, and then a toner patch forming position is determined to be in the non-image area. Also, the image forming device of the present invention may have a construction in which a toner patch forming position is determined directly without determining the location of the image area or the non-image area. More specifically, for example, the image forming device may directly determine, as an area to include a toner patch forming position, an area that includes the largest value of the electric resistance variation on the surface of the image carrier.

Also, the image forming device of the present invention is not limited to a construction in which the location of the image area is determined such that the non-image area at least includes an area having the larges value of the electric resistance variation in the belt running direction. The image forming device of the present invention may have a construction in which it can determine the location of the image area to exclude, as much as possible, an area having an electric resistance unevenness. For example, the image forming device may calculate an integrated value of the electric resistance variation for each predetermined section in the belt running direction, and may determine the location of the image area such that the non-image area includes areas having larger integrated values.

Also, not limited to a construction in which a toner patch is formed at a position where the electric resistance is closest to the average value among electric resistances in the image area, the image forming device of the present invention may have, for example, a construction in which it forms a toner patch at a position where the electric resistance variation is small. With this construction, it is easy to form a toner patch in good conditions, which would contribute to the improvement in the detection accuracy of the toner patch detecting unit. Alternatively, the image forming device of the present invention may have a construction in which it forms a toner patch at a position where the electric resistance variation is large. This construction ensures that the image area excludes a position where the electric resistance variation is large.

Also, not limited to a construction in which it measures the electric resistance by sampling the current values under a constant voltage control, the image forming device of the present invention may have a construction in which it measures the electric resistance by sampling the voltage values under a constant current control.

Also, not limited to a construction in which it measures the electric resistance distribution on the surface of the image carrier per predetermined number of prints, the image forming device of the present invention may have a construction in which it measures the electric resistance distribution for each state that may change the electric resistance. For example, it may measure the electric resistance distribution for each environmental change in temperature, humidity or the like. More specifically, for example, the image forming device may measure the electric resistance distribution each time the surrounding temperature of the image forming device changes by 5° C.

Also, not limited to a construction in which it forms a toner patch only by a black toner, the image forming device of the present invention may have a construction in which it forms a toner patch as layers of multiple colors, or by a single color other than black.

<Image Forming Method>

The present invention is not limited to an image forming device, but may be an image forming method or a program that causes a computer to execute the image forming method. The program achieving the present invention may be recorded on various computer-readable recording mediums such as: magnetic tape; a magnetic disk such as a flexible disk; an optical recording medium such as DVD-ROM, DVD-RAM, CD-ROM, CD-R, MO, or PD; and a flash-memory-type recording medium. The present invention may be produced or transferred in the form of the above-mentioned recording medium, or may be sent or supplied in the form of the above-mentioned program via: one of various wired/wireless networks including the Internet; a broadcast; an electric communication line; a satellite communication or the like.

It is not necessary for the above-mentioned program to include all the modules for the above-described processes to be executed by the computer. For example, part of the processes of the present invention to be executed by the computer may be achieved by general-purpose programs that can be installed in an information processing device, such as the programs contained in a communication program or an operating system (OS) Accordingly, the recording medium of the present invention does not necessarily record all the above-mentioned modules, nor is it necessary to send all the modules. Furthermore, predetermined processes of the present invention may be executed using dedicated hardware.

INDUSTRIAL APPLICABILITY

The image forming device of the present invention can be used for printers, MFPs (Multi Function Peripherals), copy machines, facsimile machines and the like. The image forming device of the present invention can be used for monochrome printers, as well as full-color printers.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image forming device comprising:

an image carrier, being an endless belt, on which a toner image is to be formed;

a resistance measuring unit operable to measure a distribution of electric resistances on a surface of the image carrier;

a toner patch forming position determining unit operable to determine a position at which a toner patch is to be formed, according to a result of the measurement by the resistance measuring unit;

a toner patch forming unit operable to form the toner patch on the image carrier surface at the position determined by the toner patch forming position determining unit;

a toner patch detecting unit operable to detect the toner patch formed on the image carrier surface; and an image control unit operable to control a timing for forming the toner image on the image carrier surface, taking a position of the detected toner patch into account.

2. The image forming device of claim 1, wherein the toner patch forming position determining unit determines a location of an image area based on a result of the measurement by the resistance measuring unit, and determines, as the toner patch forming position, a position that is included in an area other than the image area.

3. The image forming device of claim 2, wherein the toner patch forming position determining unit determines the location of the image area such that the area other than the image area at least includes an area having a largest value of electric resistance variation in a belt running direction.

4. The image forming device of claim 2, wherein the toner patch forming position determining unit calculates an average value among electric resistances in the image area, and determines, as the toner patch forming position, a position that belongs to the area other than the image area, and has an electric resistance that is closest to the calculated average value.

5. The image forming device of claim 1, wherein the resistance measuring unit measures the distribution of electric resistances by sampling either current values under a constant voltage control or voltage values under a constant current control.

6. The image forming device of claim 5 further comprising a transferring unit operable to transfer the toner image from the image carrier onto a paper sheet, wherein the sampling of current values or voltage values is performed via the transferring unit at a position on the image carrier surface from which the toner image is transferred onto the paper sheet.

7. The image forming device of claim 1, wherein the resistance measuring unit measures the distribution of electric resistances on the image carrier surface either each time a predetermined number of paper sheets are printed or each time a predetermined environmental change occurs, the toner patch forming position determining unit re-determines the position at which the toner patch is to be formed, each time the resistance measuring unit measures the distribution of electric resistances, and each time the toner patch forming position determining unit re-determines the position, the toner patch forming unit re-forms the toner patch at the re-determined position.

8. The image forming device of claim 1, wherein an image control sensor functions as the toner patch detecting unit.

9. The image forming device of claim 1, wherein the toner patch forming position determining unit determines, as a location of an image area, a location that is small in variation of the electric resistance based on a result of the measurement by the resistance measuring unit, and determines, as the toner patch forming position, a position that is included in an area other than the image area.

10. An image forming device that, for formation of a color image, transfers toner images of different colors one by one onto an intermediate transfer member being rotated, the image forming device comprising:

a resistance measuring unit operable to measure a distribution of electric resistances on a surface of the intermediate transfer member;

a storage unit operable to store electric resistances of one circuit of the intermediate transfer member measured by the resistance measuring unit;

a toner patch forming position determining unit operable to determine a position at which a toner patch is to be formed, according to the electric resistances of the intermediate transfer member stored in the storage unit;

a toner patch forming unit operable to form the toner patch on the intermediate transfer member surface;

a toner patch detecting unit that is arranged to face the intermediate transfer member, and detects the toner patch on the intermediate transfer member surface; and an image control unit operable to control timings for transferring toner images of different colors, one by one in layers, onto the intermediate transfer member surface, taking a position of the detected toner patch into account.

11. The image forming device of claim 10, wherein the toner patch forming position determining unit determines the position at which the toner patch is to be formed, based on the electric resistances of the intermediate transfer member stored in the storage unit, such that the toner images of the different colors are transferred one by one into an area that has a small electric resistance variation.

12. The image forming device of claim 10 further comprising:

one photosensitive drum; and a plurality of developers that are arranged to selectively face the photosensitive drum, wherein the toner patch forming unit forms a black toner patch, which is formed by one of the plurality of developers that uses a black toner, on the intermediate transfer member surface.

13. An image forming method comprising the steps of:

measuring a distribution of electric resistances on a surface of an image carrier which is an endless belt and on which a toner image is to be formed;

determining a position at which a toner patch is to be formed, according to a result of the measurement in the electric resistance distribution measuring step;

forming the toner patch on the image carrier surface at the position determined in the toner patch forming position determining step;

detecting the toner patch formed on the image carrier surface; and controlling a timing for forming the toner image on the image carrier surface, taking a position of the detected toner patch into account.

14. The image forming method of claim 13, wherein the step of determining includes determining, as a location of an image area, a location that is small in variation of the electric resistance based on a result of the measuring step, and determining, as the toner patch forming position, a position that is included in an area other than the image area.

* * * * *